US010927563B2

(12) United States Patent
Geise

(10) Patent No.: US 10,927,563 B2
(45) Date of Patent: Feb. 23, 2021

(54) PLUG DEVICE FOR SWIMMING POOL FENCE SYSTEM AND RELATED METHODS

(71) Applicant: Bradley Geise, Orlando, FL (US)

(72) Inventor: Bradley Geise, Orlando, FL (US)

( * ) Notice: Subject to any disclaimer, the term of this patent is extended or adjusted under 35 U.S.C. 154(b) by 773 days.

(21) Appl. No.: 15/800,562

(22) Filed: Nov. 1, 2017

(65) Prior Publication Data

US 2019/0128016 A1 May 2, 2019

(51) Int. Cl.

| | |
|---|---|
| ***E04H 17/20*** | (2006.01) |
| ***E04H 4/06*** | (2006.01) |
| ***E04H 17/08*** | (2006.01) |
| ***E04H 17/00*** | (2006.01) |

(52) U.S. Cl.

CPC ..... *E04H 17/20* (2013.01); *E04H 4/06* (2013.01); *E04H 17/08* (2013.01); *E04H 2017/006* (2013.01)

(58) Field of Classification Search

CPC ..... E04H 17/08; E04H 17/20; E04H 17/22; E04H 17/18; E04H 2017/006; E04H 4/06; E04H 12/22; E04H 12/2207

See application file for complete search history.

(56) References Cited

U.S. PATENT DOCUMENTS 3,391,515 A * 7/1968 Clay ..... E04B 1/415 52/709
4,194,338 A * 3/1980 Trafton ..... E04C 3/32 256/65.03
4,458,395 A * 7/1984 Aoki ..... A45C 13/1069 24/303
5,192,054 A * 3/1993 Sharp ..... F16B 17/004 256/24
6,789,786 B1 * 9/2004 Schatzberg ..... E04H 4/06 256/25
6,810,631 B2 11/2004 Kraft
6,893,007 B2 * 5/2005 Asenbauer ..... E04H 4/06 256/19
7,389,573 B2 6/2008 Pesta
8,063,778 B2 * 11/2011 Johns ..... B01J 8/0015 340/540

(Continued)

FOREIGN PATENT DOCUMENTS

DE 2041894 A1 * 3/1972 ..... E04H 12/22
FR 2865754 A1 * 8/2005 ..... E04H 4/06

OTHER PUBLICATIONS

Pool Fence Parts, website, http://poolfenceparts.com, 2012.

*Primary Examiner* — Jonathan P Masinick
(74) *Attorney, Agent, or Firm* — Allen, Dyer, Doppelt + Gilchrist, P.A.

(57) ABSTRACT

A plug device may be for a swimming pool fence system that includes spaced apart vertical fence posts to be inserted into corresponding fence post openings in a pool deck, and a fencing material coupled between adjacent spaced apart vertical fence posts. The plug device may include a cylindrical body having opposing first and second ends. The first end may be adjacent a distal end of a respective fence post opening in the pool deck upon insertion therein. The plug device may include a magnet carried by the second end of the cylindrical body. The plug device may also include a cylindrical pool deck cap carried by the magnet. The cylindrical pool deck cap may be adjacent a proximal end of the respective fence post opening in the pool deck upon insertion therein.

20 Claims, 19 Drawing Sheets

(56) References Cited

U.S. PATENT DOCUMENTS

| | | | | |
|---|---|---|---|---|
| 8,099,803 | B2 * | 1/2012 | Pesta | E04H 17/163 4/496 |
| 8,370,970 | B2 | 2/2013 | Reavis | |
| 8,579,262 | B2 | 11/2013 | Sadinsky et al. | |
| 9,127,469 | B1 * | 9/2015 | England | E04H 4/12 |
| 9,334,670 | B2 * | 5/2016 | Cowie | E04H 17/00 |
| 9,353,539 | B2 | 5/2016 | Shebek et al. | |
| 9,427,114 | B2 | 8/2016 | Tong | |
| 10,100,551 | B2 * | 10/2018 | Pacheco | E04H 17/20 |
| 10,655,514 | B2 * | 5/2020 | Hori | F01M 11/10 |
| 2005/0109998 | A1 * | 5/2005 | Sadinsky | E04H 4/06 256/25 |
| 2008/0141450 | A1 | 6/2008 | Pesta | |
| 2009/0155124 | A1 * | 6/2009 | Wan | B01L 3/502 422/68.1 |
| 2015/0204106 | A1 * | 7/2015 | Hedley | E04H 17/26 256/32 |
| 2020/0018086 | A1 * | 1/2020 | Durrant | E04H 12/2292 |

* cited by examiner

PLUG DEVICE FOR SWIMMING POOL FENCE SYSTEM AND RELATED METHODS

TECHNICAL FIELD

The present application is directed to the field of fence systems, and more particularly, to the field of standalone swimming pool fences and related methods.

BACKGROUND

A swimming pool is a relatively popular structure, both for swimming and other leisure activities. For example, a swimming pool may be a popular source of entertainment for young children, particularly during warmer times of the year. Additionally, a swimming pool is an increasingly common improvement to a residential home, particularly in warmer climate regions.

Because of its popularity as a source of entertainment and exercise, particularly with younger children, a swimming pool may also present a risk of death due to drowning. For example, in the warmer climate regions, drowning may be considered a relatively significant cause of childhood fatalities.

In an attempt to reduce the amount of swimming pool related fatalities in children, many jurisdictions require some form of fencing, barrier, alarm, and/or combination thereof to limit access to the swimming pool. One exemplary safety product to limit access to a swimming pool is a mesh fence.

A mesh fence typically surrounds the entire swimming pool area or body of water and includes spaced apart fence posts that are removable positioned within corresponding openings in the pool deck. The openings are typically formed by drilling the opening into the pool deck, which may be concrete, block, or other stone. A mesh fence material is between and coupled to adjacent fence posts. A mesh fence may include a lockable access gate to provide access to the swimming pool.

Where the mesh fence does not include an access gate and access to the swimming pool is desired, or where use of the mesh fence is no longer desired, the mesh fence may be removed. Each fence post is removed from the corresponding fence post opening in the pool deck leaving an opening in the pool deck. The fence post openings in the pool deck may be considered to be aesthetically displeasing or unsightly as they may fill with dirt or debris or make a home for insects. The fence post opening may also be a tripping hazard. To address the safety and aesthetics of the open fence post openings, each opening may be fitted with a pool fence deck plug. A typical pool fence deck plug is plastic and includes a short base, relative to the fence post opening, coupled to a cover. The short base is inserted into the fence post opening until a lip of the cover contacts the pool deck. The pool fence deck plug may be painted or stained to match the pool deck, for example. In its resting and inserted position, the pool fence deck plug rests slightly above the pool deck, which may make it susceptible to chipping of the paint and may present still a tripping hazard.

SUMMARY

A plug device is for a swimming pool fence system that may include a plurality of spaced apart vertical fence posts to be inserted into corresponding fence post openings in a pool deck, and a fencing material coupled between adjacent ones of the plurality of spaced apart vertical fence posts. The plug device may include a cylindrical body having opposing first and second ends. The first end may be adjacent a distal end of a respective fence post opening in the pool deck upon insertion therein. The plug device may also include at least one magnet carried by the second end of the cylindrical body and a cylindrical pool deck cap body carried by the at least one magnet. The cylindrical pool deck cap may be adjacent a proximal end of the respective fence post opening in the pool deck upon insertion therein.

The at least one magnet may have a cylindrical shape, for example. The at least one magnet and the cylindrical pool deck body may have a diameter within +/−25% of each other.

The cylindrical pool deck cap may include a cylindrical frame carried by the at least one magnet and having an opening therein. A pool deck insert body may be carried within the opening.

The cylindrical body, the at least one magnet, and the cylindrical pool deck cap may have a combined length within a range of 4-inches+/−I-inch, for example. The cylindrical body may have at least one enlarged cylindrical end segment and an elongate segment coupled thereto having a reduced width relative to the enlarged cylindrical end segment, for example. The at least one enlarged cylindrical end segment may include first and second enlarged cylindrical end segments coupled to opposing ends of the elongate segment, for example.

The cylindrical body and the cylindrical pool cap body may each have as a diameter of 1-inch+/−0.5 inch, for example. The cylindrical body may include a solid cylindrical body.

The cylindrical pool deck cap may include a solid cylindrical pool deck cap. The cylindrical pool deck cap may have a groove therein along a circumference thereof, and the plug device may further include a seal carried within the groove, for example. The cylindrical pool deck cap may have a planar end surface aligned in plane with the pool deck.

A method aspect is directed to a method of making a plug device for a swimming pool fence system that includes a plurality of spaced apart vertical fence posts to be inserted into corresponding fence post openings in a pool deck, and a fencing material coupled between adjacent ones of the plurality of spaced apart vertical fence posts. The method may include coupling at least one magnet to a second end of a cylindrical body having a first end opposing the second end, the first end to be adjacent a distal end of a respective fence post opening in the pool deck upon insertion therein. The method may also include coupling a cylindrical pool deck cap body to the at least one magnet. The cylindrical pool deck cap may be adjacent a proximal end of the respective fence post opening in the pool deck upon insertion therein.

DETAILED DESCRIPTION

Figure 1:
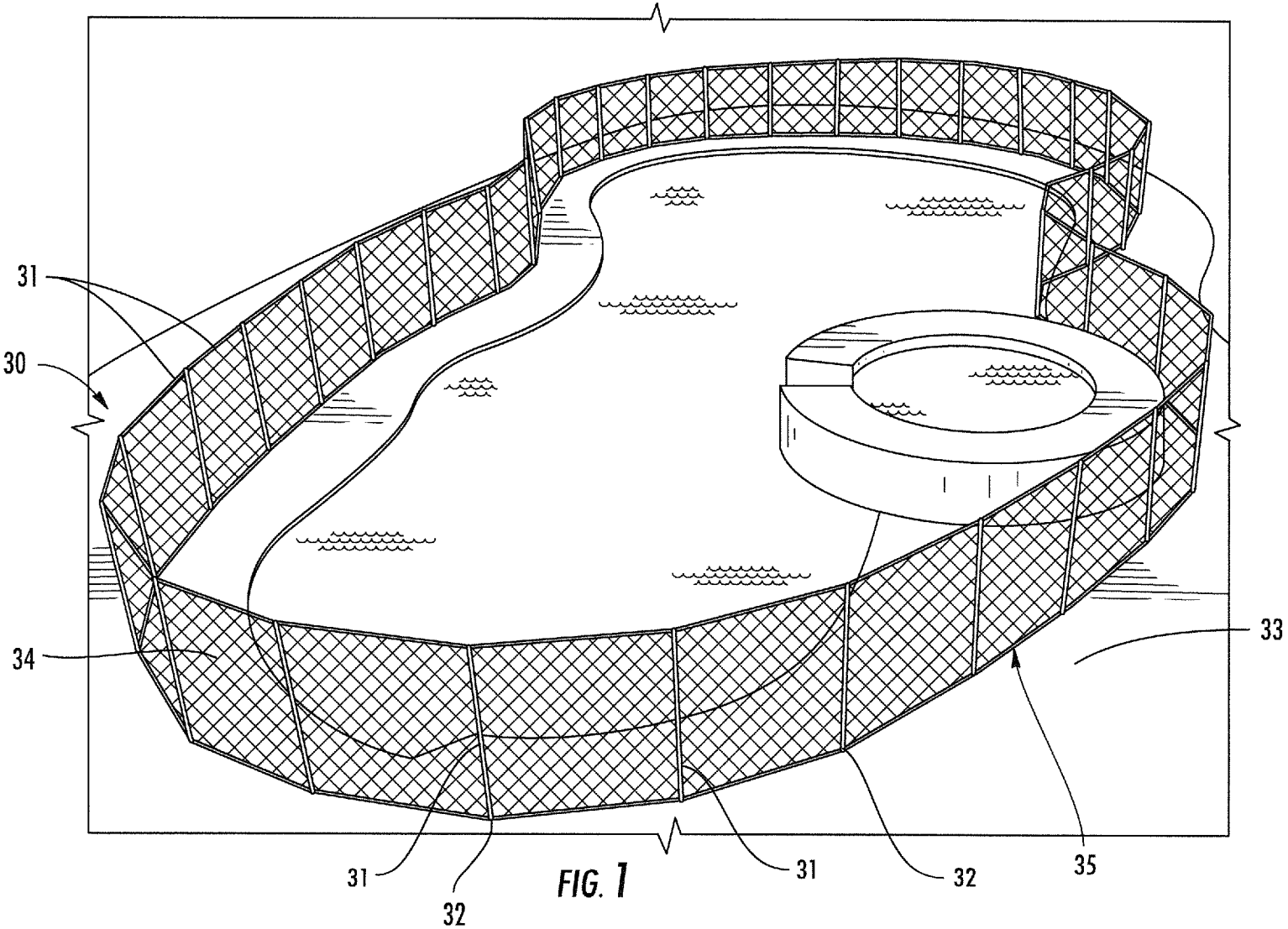
FIG. 1 is a perspective view of a swimming pool fence system for use with a plug device according to an embodiment.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Referring initially to FIGS. 1-6, a plug device 40 is for a swimming pool fence system 30. The swimming pool fence system 30 includes spaced apart vertical fence posts 31 that are inserted into corresponding fence post openings 32 in a pool deck 33. A fencing material 34, for example, a mesh material, glass, or plexiglass, is coupled between adjacent spaced apart vertical fence posts 31 defining a swimming pool fence 35.

Figure 2:
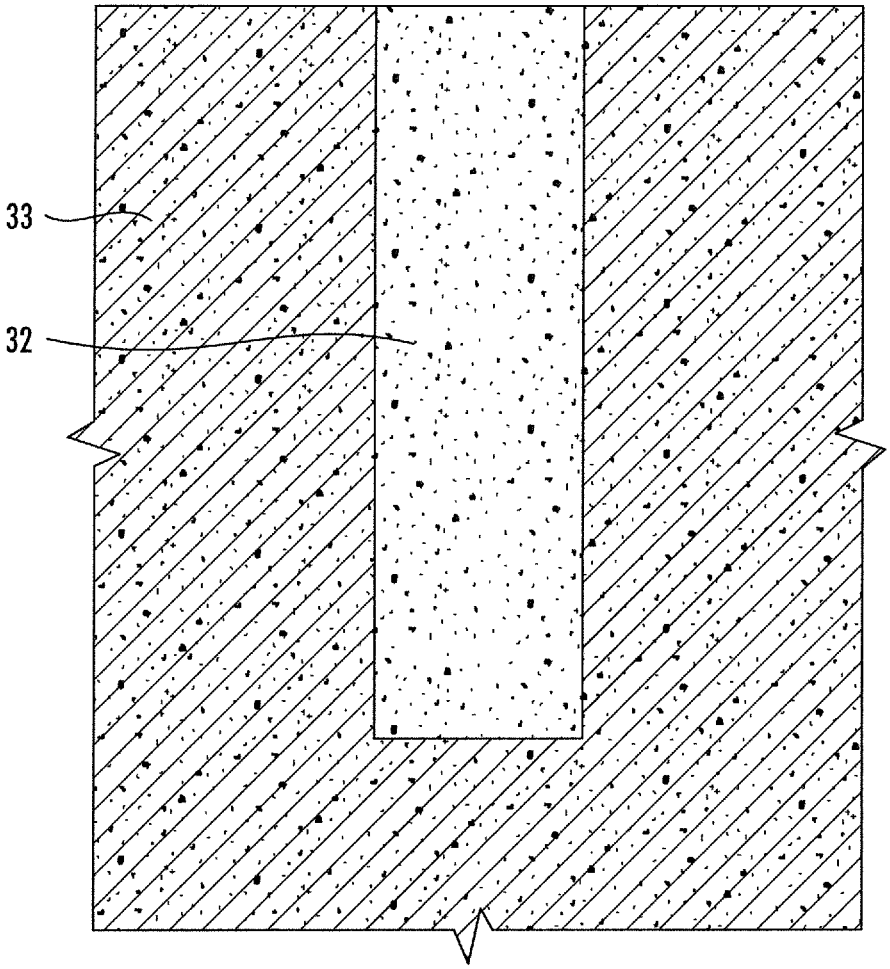
FIG. 2 is a cross sectional view of a pool deck including a fence post opening for use with a plug device according to an embodiment.
Figure 3:
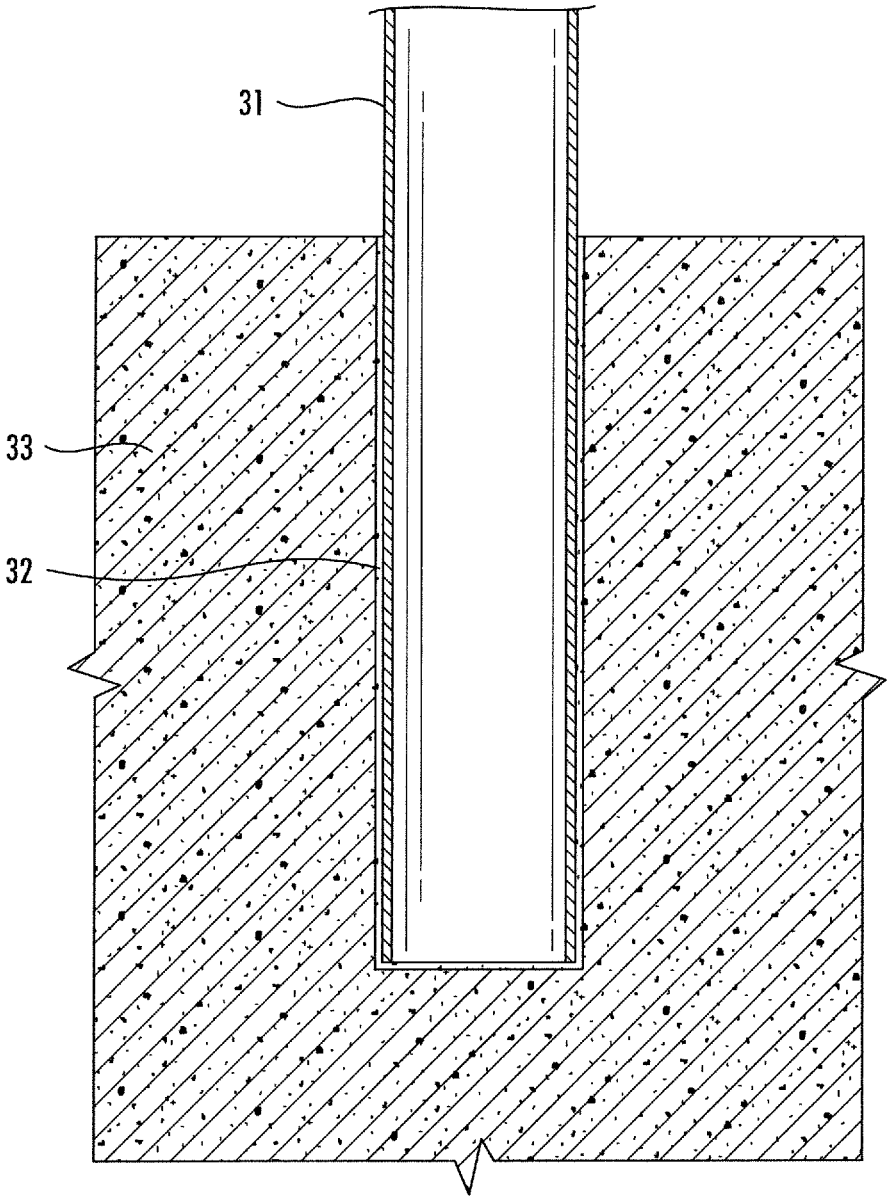
FIG. 3 is a cross sectional view of the pool deck including the fence post opening of FIG. 2 having a vertical fence post inserted therein.
Figure 4:
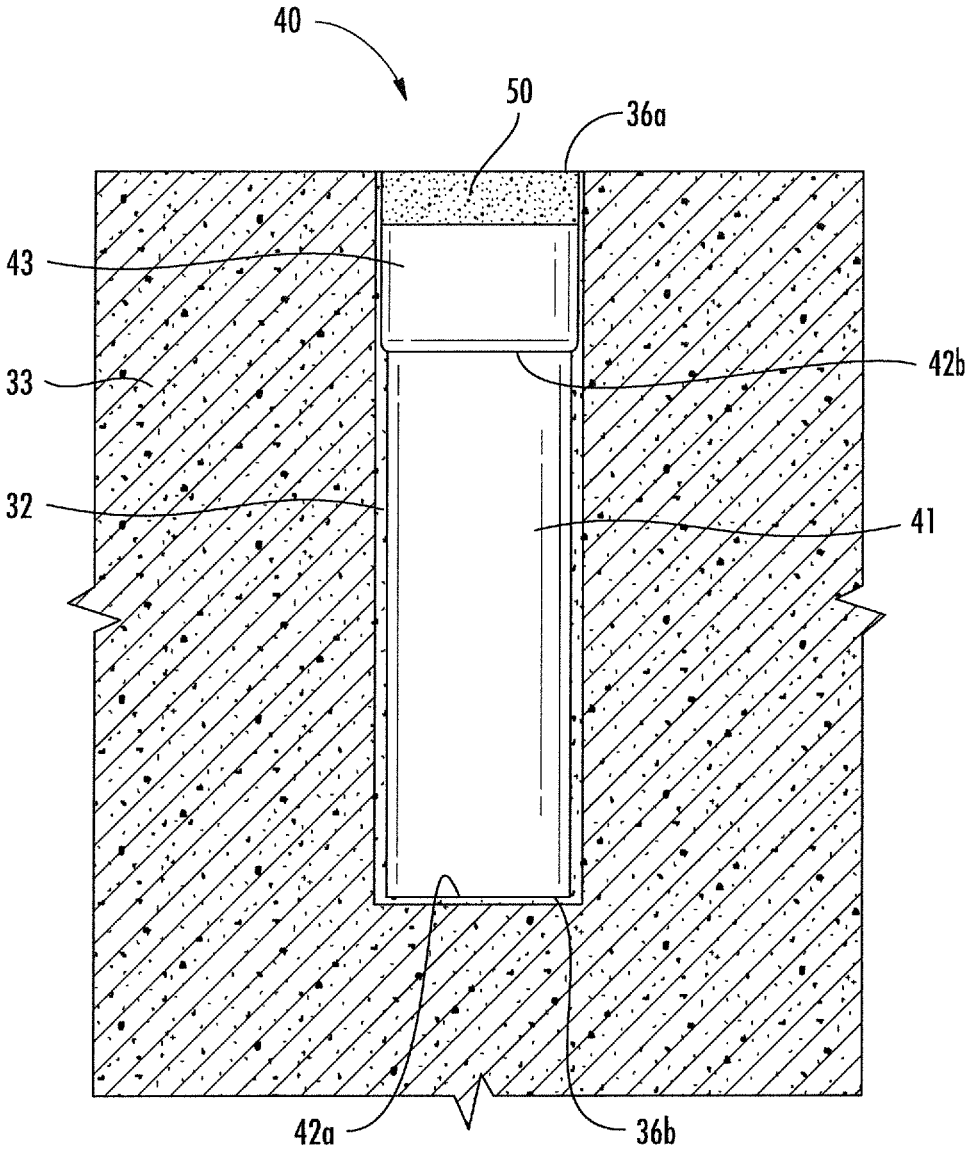
FIG. 4 is a cross sectional view of a pool deck including a plug device according to an embodiment.
Figure 5:
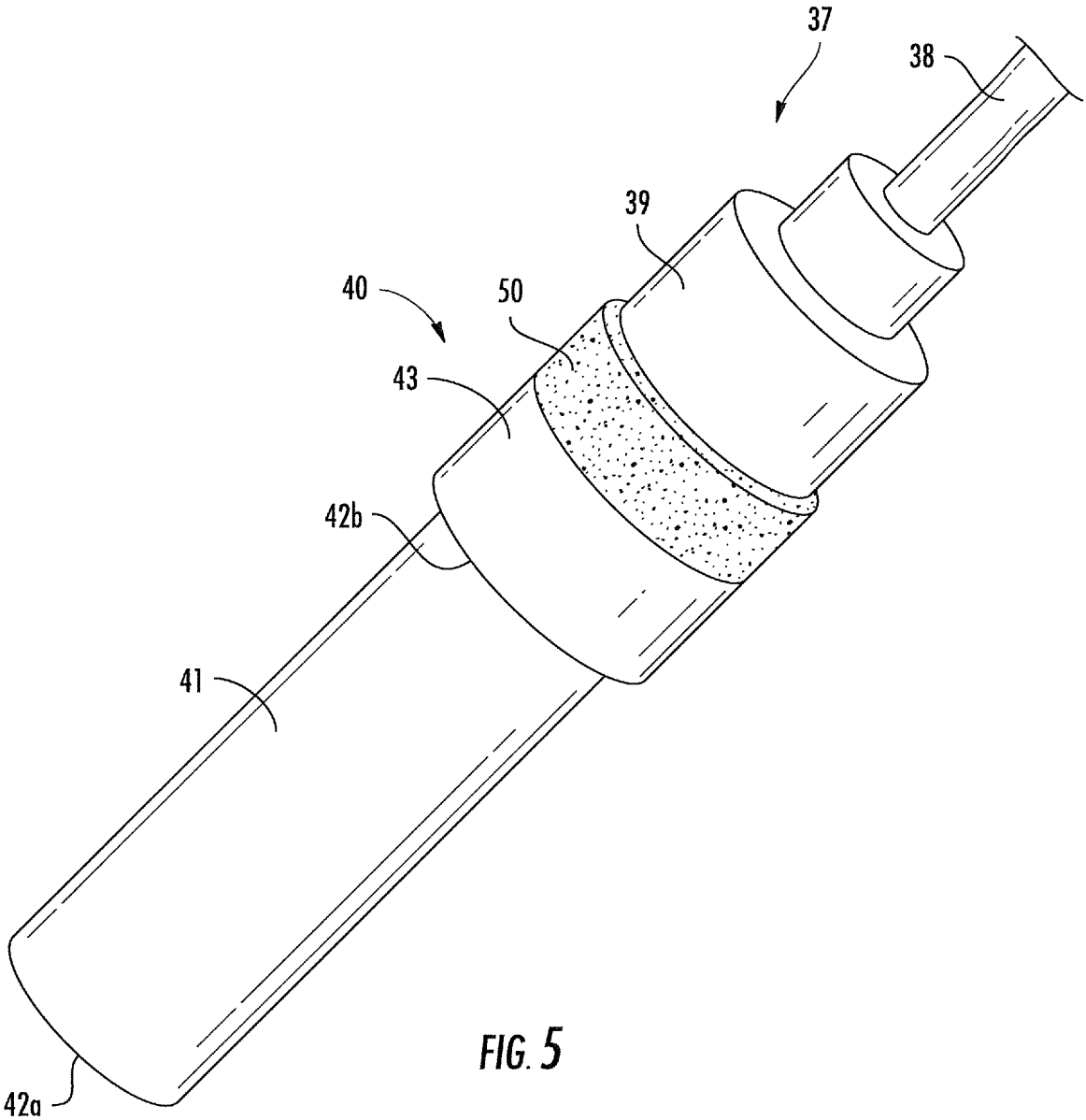
FIG. 5 is a perspective view of the plug device of FIG. 4 and a plug removal device according to an embodiment.
Figure 6:
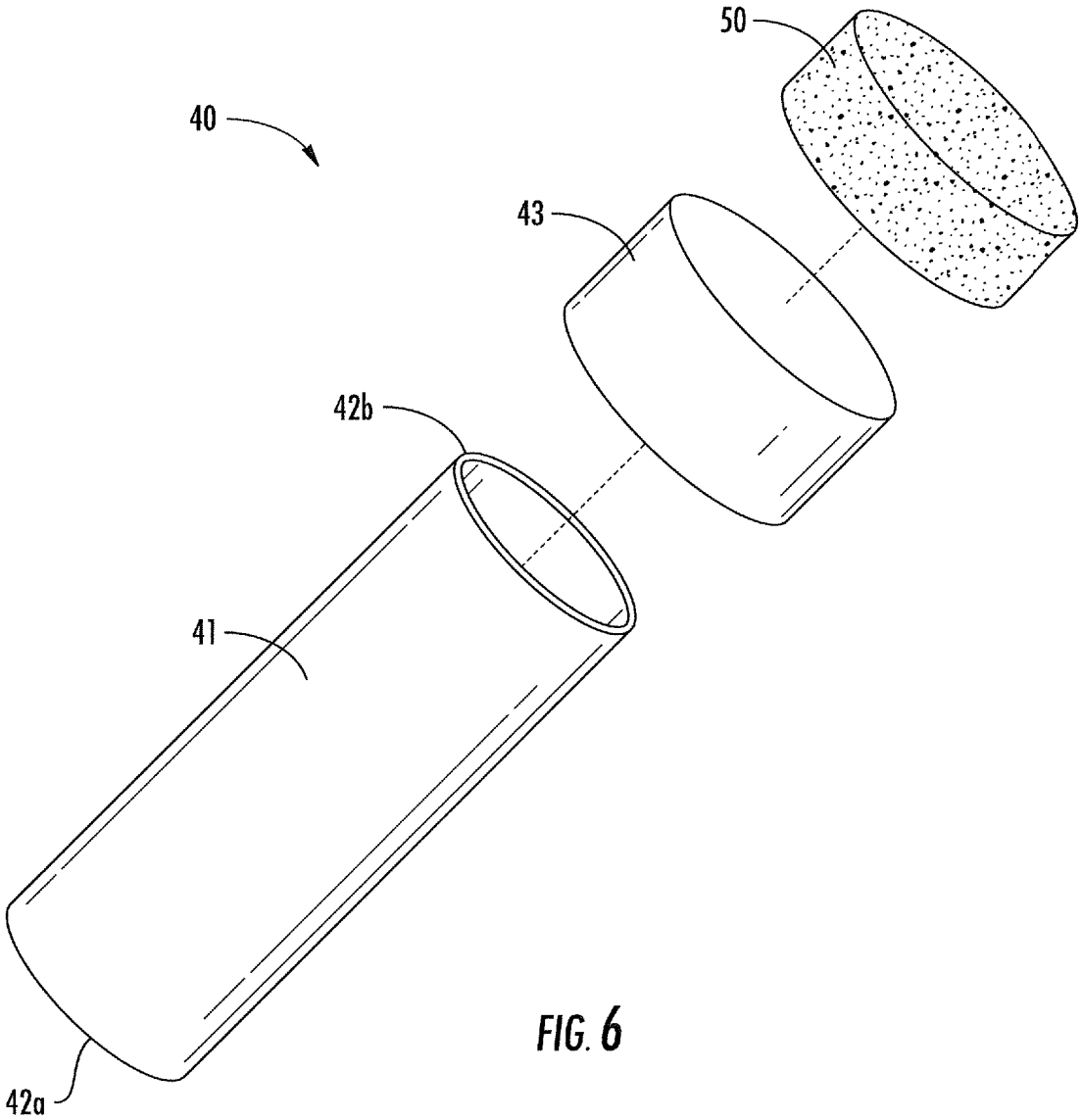
FIG. 6 is an exploded view of the plug device of FIG. 5.

However, when the swimming pool fence 35 is not in use or is not erect, the fence post openings 32 will be exposed or uncovered (FIG. 2). Accordingly, the plug device 40 may be inserted into a respective fence post opening 32. The plug device 40 illustratively includes a cylindrical body 41 having an elongate shape and opposing first and second ends 42*a*, 42*b*. During operation, the first end 42*a* is inserted into a fence post opening 32 in the pool deck 33 so that the first end is adjacent a distal end 36*b* or lower end of the corresponding fence post opening 32.

Figure 7:
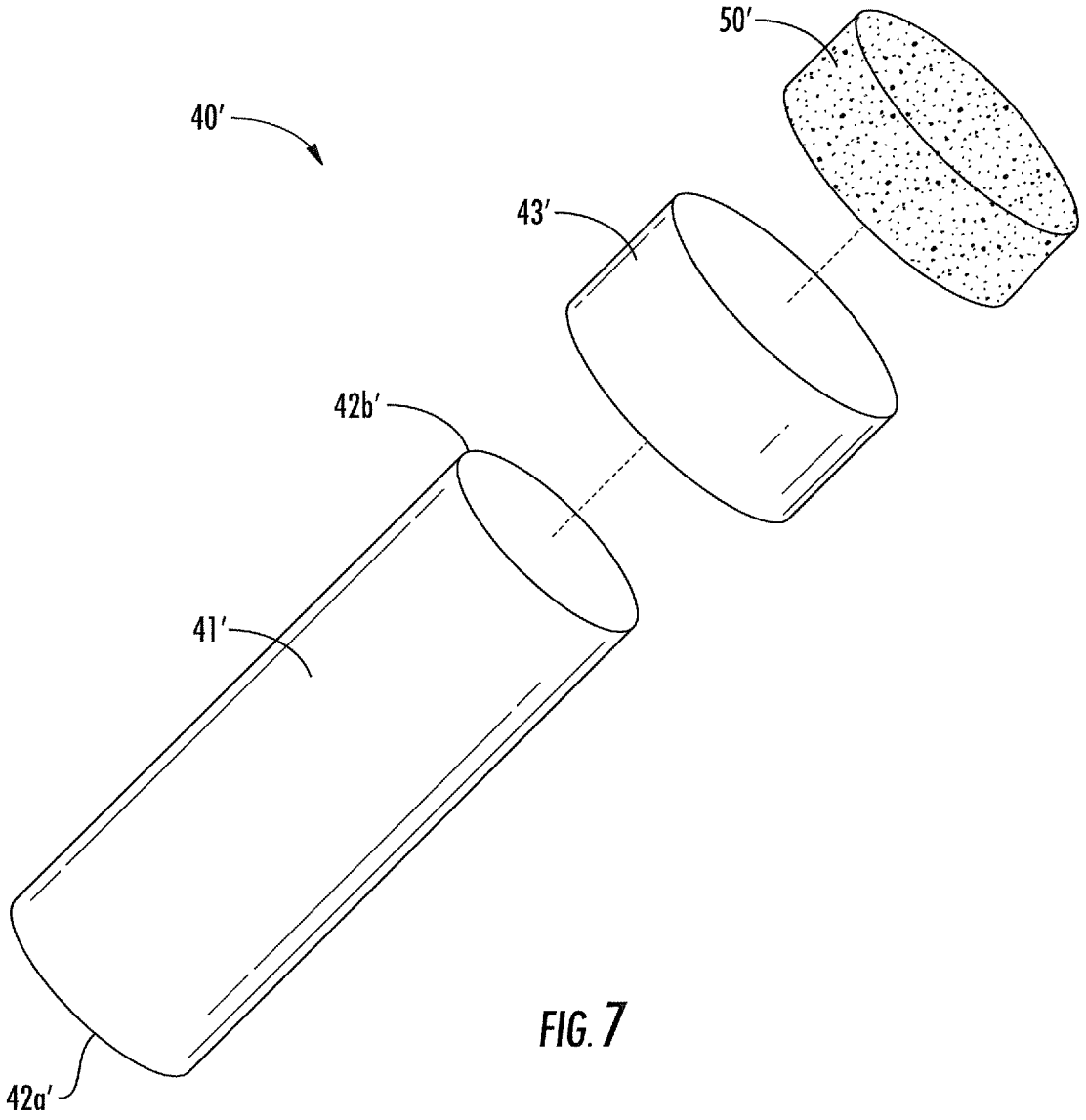
FIG. 7 is an exploded view of a plug device according to another embodiment.

The cylindrical body 41 may be hollow or tubular, as illustrated. In some embodiments, for example, as illustrated in FIG. 7, the cylindrical body 41' may be solid. The cylindrical body 41 may be rigid plastic, for example, polyvinyl chloride (PVC), metal (e.g., aluminum), fiberglass, or other type or combination of materials. The cylindrical body 41 may have a diameter within a range of 1-inch+/−0.5 inches, for example.

The plug device 40 also includes a magnet 43 carried by or coupled to the second end 42*b* of the cylindrical body 41 and adjacent a proximal end 36*a* of the corresponding fence post opening 32. The magnet 43 illustratively has a cylindrical shape with a diameter that is slightly larger (e.g., up to 20%) than the diameter of the cylindrical body 41. For example, the magnet 43 may have a diameter within a half inch of 1-inch, and more particularly, about an inch. As will be appreciated by those skilled in the art, most fence post openings 32 for a swimming pool fence system have an inner diameter of 1-inch. In some embodiments, the magnet 43 may have a same diameter as the cylindrical shape diameter of the cylindrical body 41 or within a 5% of the diameter of each other.

While a single magnet 43 is illustrated, there may be more than one magnet arranged in a stacked relation. The magnet 43 may be a permanent magnet and/or a neodymium magnet, for example. The magnet 43 may be another type of magnet, as will be appreciated by those skilled in the art.

The plug device 40 also includes a cylindrical pool deck cap 50 carried by the magnet 43. The cylindrical pool deck cap 50 is carried by, in stacked relation, or coupled to an upper end of the magnet 43. The cylindrical pool deck cap 50 may be a solid material and may be coupled to the magnet 43 by an adhesive material, for example, or other type of joint (e.g., solder, weld). The cylindrical pool deck cap 50 may be a solid material that matches the material of the pool deck 33. For example, the cylindrical pool deck cap 50 may be textured concrete, a brick paver material, travertine, or other natural stone. Of course, the cylindrical pool deck cap 50 may be another type of material. The cylindrical pool deck cap 50 may also have a diameter that is larger than the diameter of the cylindrical body 41, and that may be the same size as the magnet 43 or within a threshold range of the magnet (e.g. +/−25%). The cylindrical pool deck cap 50 may also have a flat or planar upper surface or end surface so that upon insertion into a corresponding fence post opening 32, the plug device is flush with the upper surface of the pool deck 33 or the pool deck surface. In some embodiments, the cylindrical pool deck cap 50 may have a curved upper surface, for example, a convex surface so that water is displaced outwardly from a center of the cylindrical pool deck cap 50.

Figure 8:
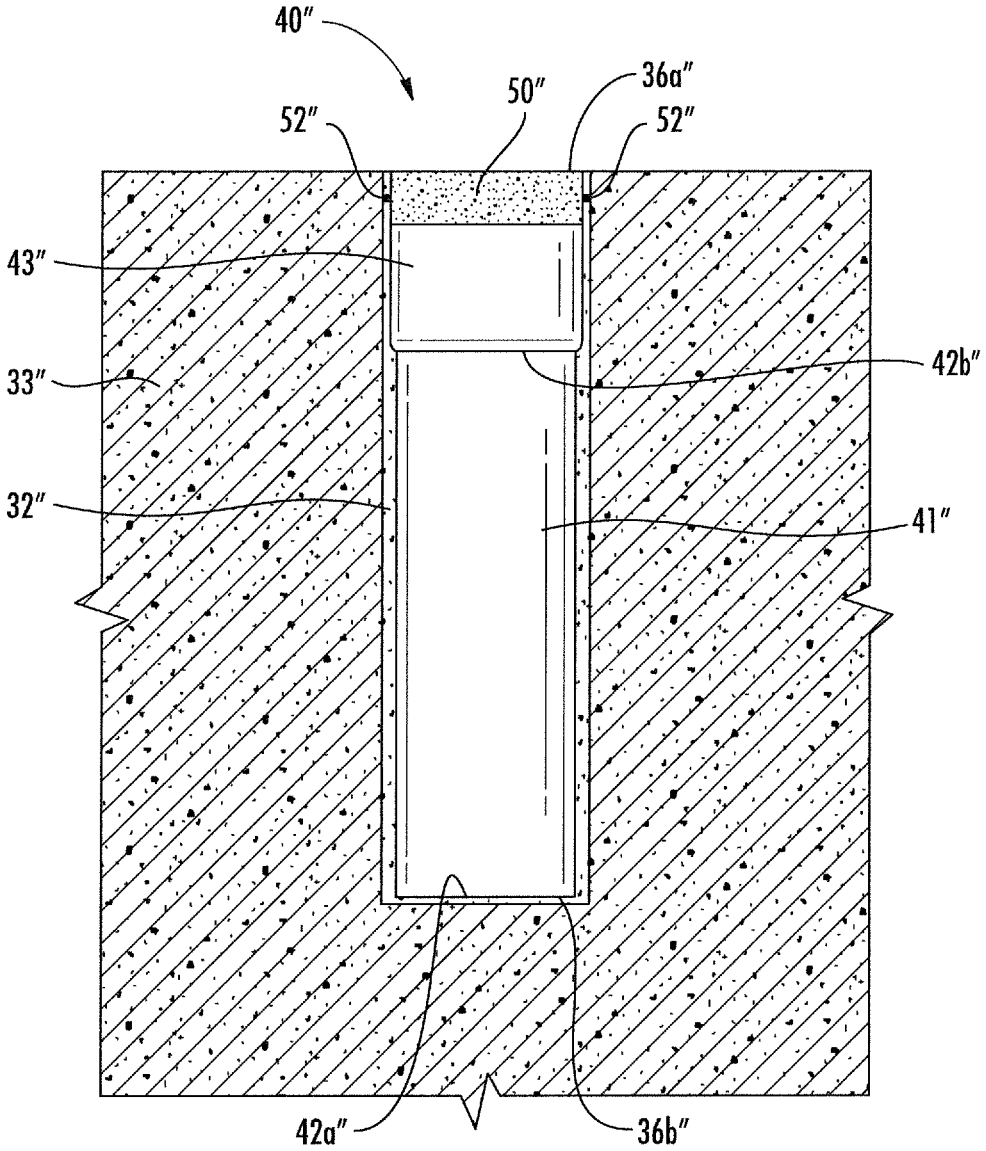
FIG. 8 is a cross sectional view of a pool deck including a plug device according to an embodiment.
Figure 9:
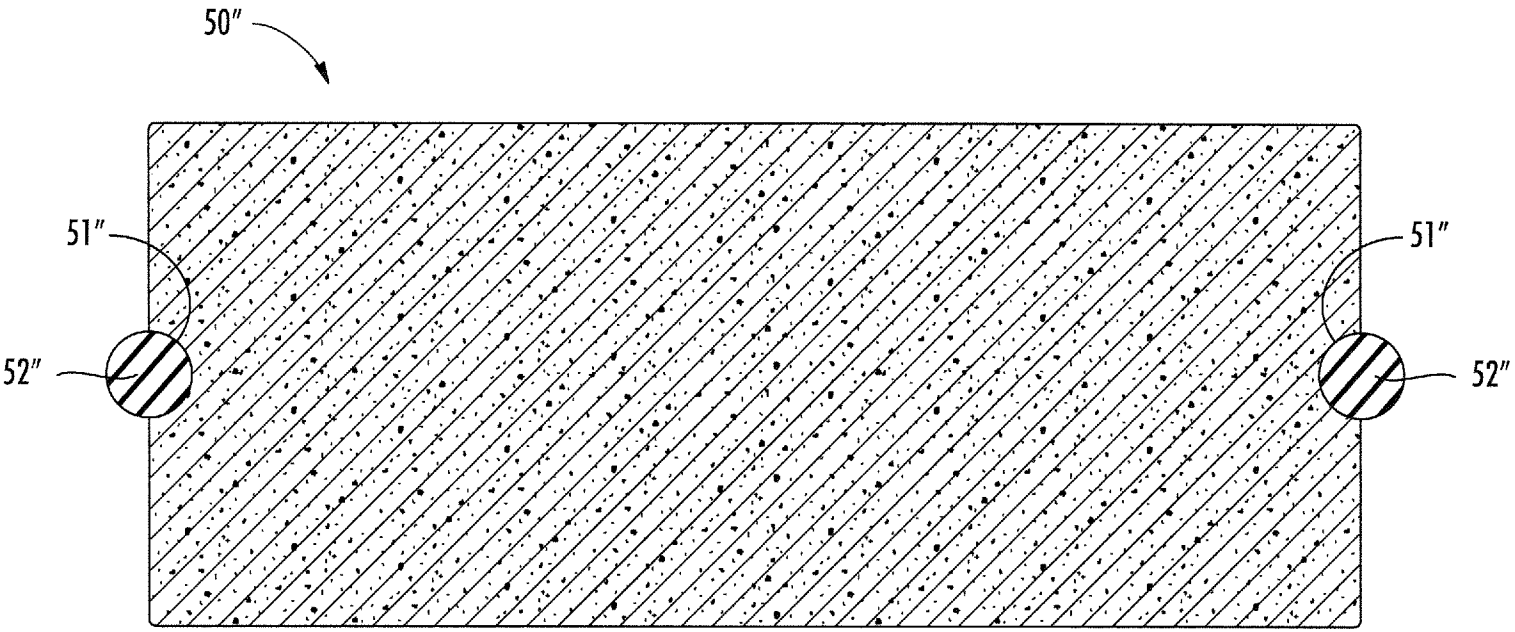
FIG. 9 is a cross sectional view of the pool deck cap and seal of the plug device of FIG. 8.

Referring briefly to FIGS. 8 and 9, in some embodiments, the cylindrical pool deck cap 50" may have a recess 51" or groove along the outer circumference thereof carrying a seal 52", for example, an o-ring, elastic seal, etc. The seal 52" may contact adjacent inside portions of the corresponding fence post opening 32" and provide increased stability and fitment of the plug device 40" within the corresponding fence post opening.

The plug device 40 may have an overall length of within a range of 4-inches+/−1-inch, for example. More particularly, the cylindrical body 41, the magnet 43, and the cylindrical pool deck cap 50 have a combined length in a stacked relation of within a range of 4-inches+/−1-inch. As will be appreciated by those skilled in the art, each fence post opening 32 typically extends about 4-inches below the upper surface of the pool deck 33 (i.e., the pool deck surface). Thus, the plug device 40, when inserted into a corresponding fence post opening 32 would be flush to the upper surface of the pool deck 33 or aligned in plane with an upper surface of the pool deck. Of course, the combined or overall length of the plug device 40 may be different to accommodate different sized or depth fence post openings 32.

During operation, the plug device 40 is pushed, placed, or positioned into the corresponding fence post opening 32, for example, by a user. Depending on the size or diameter of the magnet 43 and the cylindrical pool deck cap 50, and in embodiments that include a seal, the plug device 40 may fit relatively snug within with the corresponding fence post opening 32 and thus, the user may apply increased pressure for insertion.

When removal of the plug device 40 from the corresponding fence post opening 32 is desired, a removal device 37 or tool may be used that includes an elongate handle 38 and a metallic removal body 39 coupled to an end thereof. The elongate handle 38 may be telescoping, for example, so that a user may not have to bend to remove the plug device 40. The metallic removal body 39 may be a ferromagnetic or ferrimagnetic material, rare earth metal, or other metal that is attracted to the magnet 43. The metallic removal body 39 may itself be a magnet having a polarity opposite that of the magnet 43 of the plug device 40. When in close proximity or in contact during removal, attraction of the metallic removal body 39 and magnet 43 of the plug device 40 and relative movement of the removal device 37 cause the plug device 40 to be pulled or removed from the corresponding fence post opening 32. As will be appreciated by those skilled in the art, the attraction force between the metallic removal body 39 and the magnet 43 is larger than the force for removing the plug device 40 from the corresponding fence post opening 32. The metallic removal body 39 and magnet 43 may be relatively sized based upon the desired attraction force. Thus, subsequent to contact, for example, between the plug device 40 and the removal device 37, the user may move or pull upward from the pool deck 33 causing the plug device to be removed from the corresponding fence post opening 32.

Figure 10:
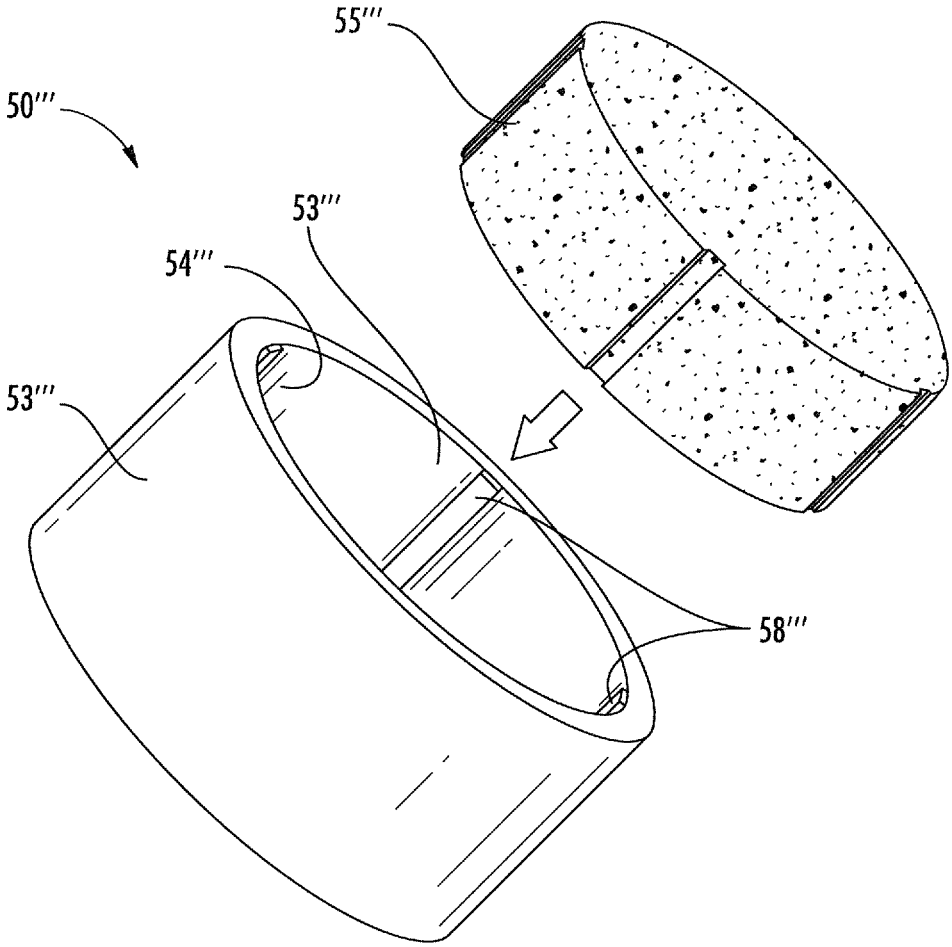
FIG. 10 is an exploded perspective view of a pool deck cap of a plug device according to an embodiment.
Figure 11:
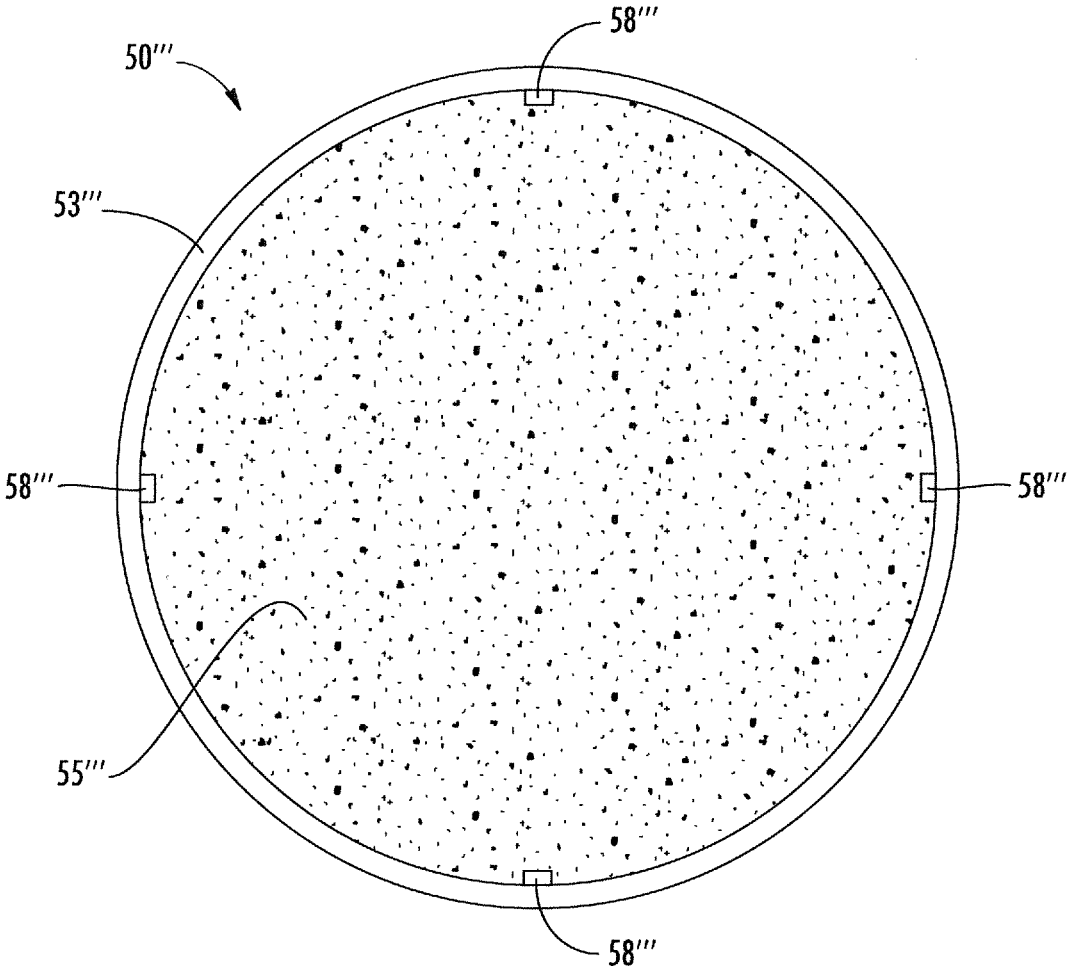
FIG. 11 is a top view of the plug device of FIG. 10.

Referring now to FIGS. 10 and 11, in another embodiment, the cylindrical pool deck cap 50''' includes a cylindrical frame 53''' coupled to or carried by the magnet 43'''. The frame 53''' has an opening 54''' therein to receive a pool deck insert body 55''' therein. Ribs 58''' may extend inwardly from the frame 53''' to provide a more secure fitment of the pool deck insert body 55''' within the opening 54'''. In some embodiments, the ribs 58''' may be tapered, or ribs may not be included. Similar to the embodiment described above, wherein the cylindrical pool deck cap 50''' includes a solid material, for example, matching the material of the pool deck 33''', the pool deck insert body 55''' may also match the material of the pool deck. However, the use of the frame 53''' advantageously permits the pool deck insert body 55''' to be interchangeable from among different types of pool deck insert bodies. Elements shown, but not specifically described with respect to FIGS. 10 and 11 are similar to those described above with respect to other embodiments and need no further discussion.

Figure 12:
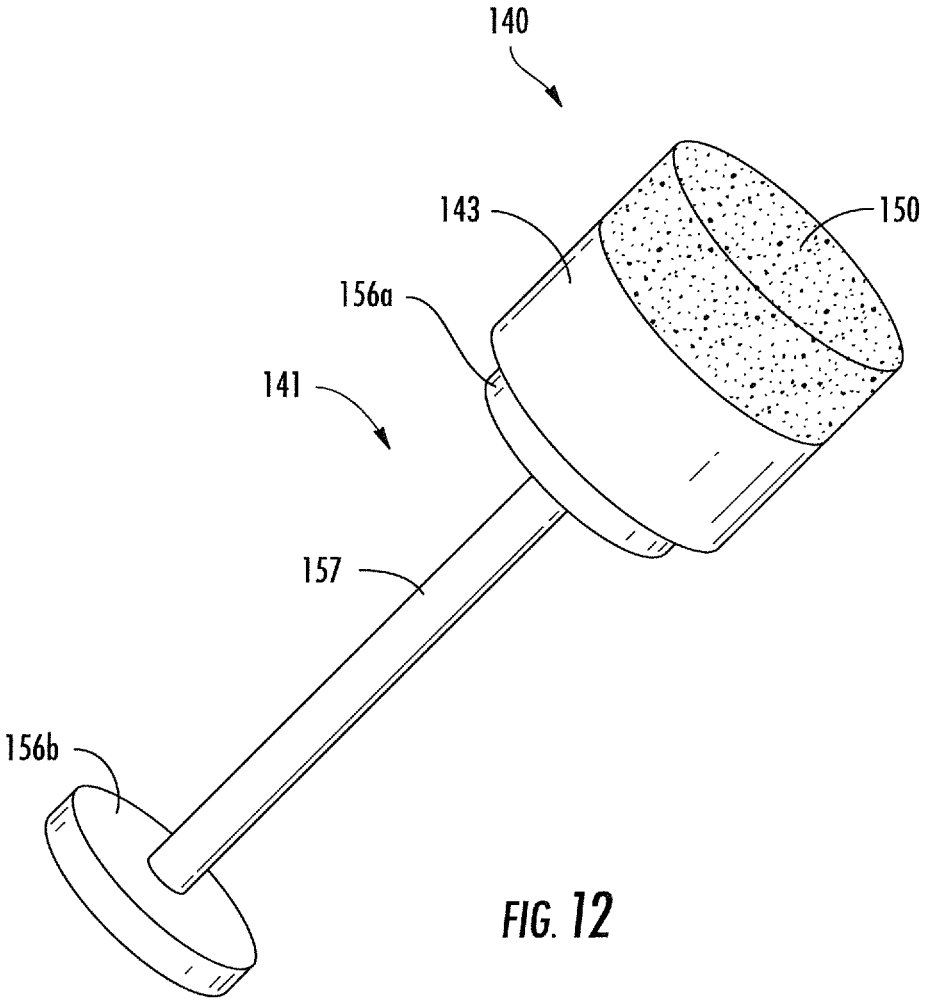
FIG. 12 is a perspective view of a plug device according to an embodiment.

Referring now to FIG. 12, in another embodiment, the cylindrical body 141 of the plug device 140 has first and second enlarged cylindrical end segments 156*a*, 156*b* and an elongate segment 157 extending between the enlarged cylindrical end segments. The elongate segment 157 has a reduced width relative to the enlarged cylindrical end segments 156*a*, 156*b*. The elongate segment 157, as having a smaller width or thickness (or diameter if cylindrical), may not be cylindrical in shape, for example. As will be appreciated by those skilled in the art, the cylindrical body 141 in the present embodiment may use less material and its configuration may provide increased structural rigidity relative to other configurations. In some embodiments, there may be only one enlarged end segment 156*a*, 156*b* adjacent the magnet 143 and the cylindrical pool deck cap 150.

Figure 13:
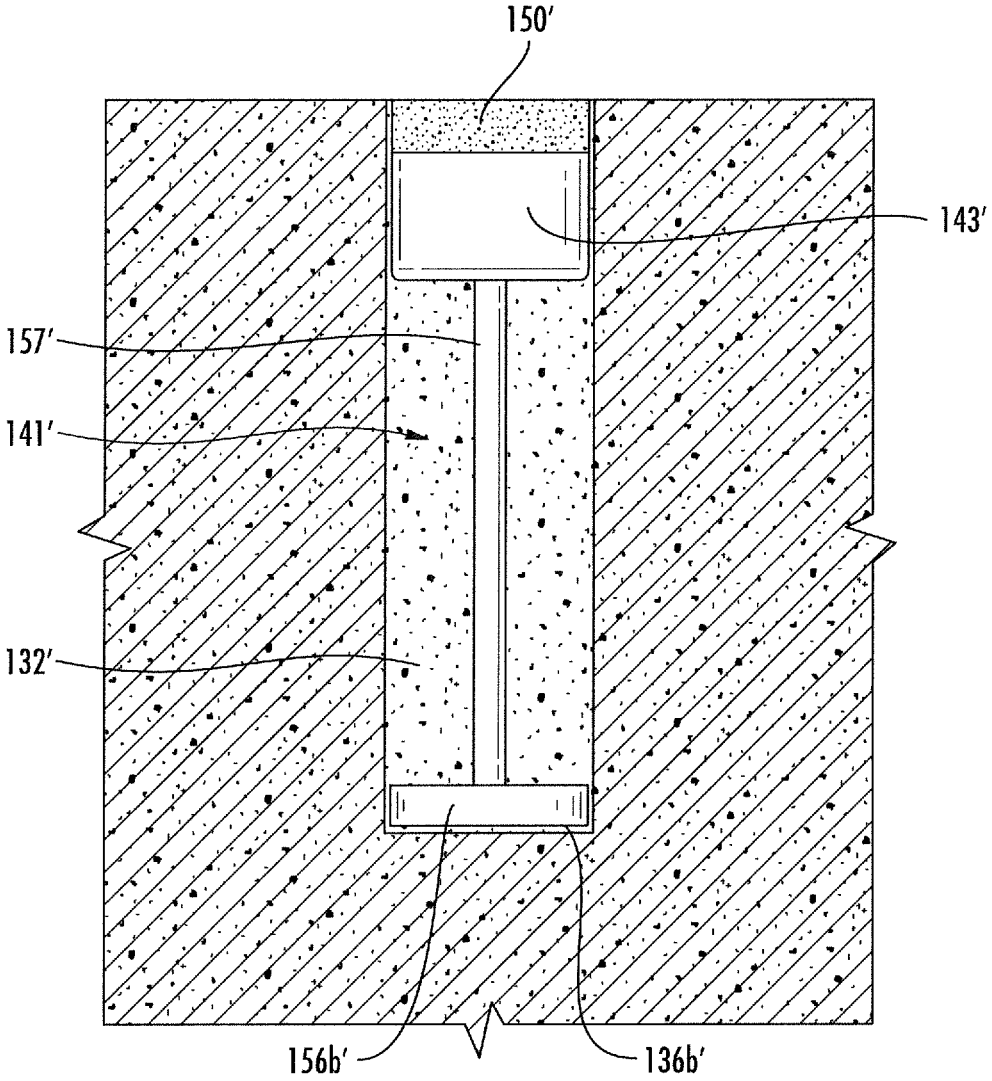
FIG. 13 is a cross sectional view of a pool deck including a plug device according to an embodiment.
Figure 14:
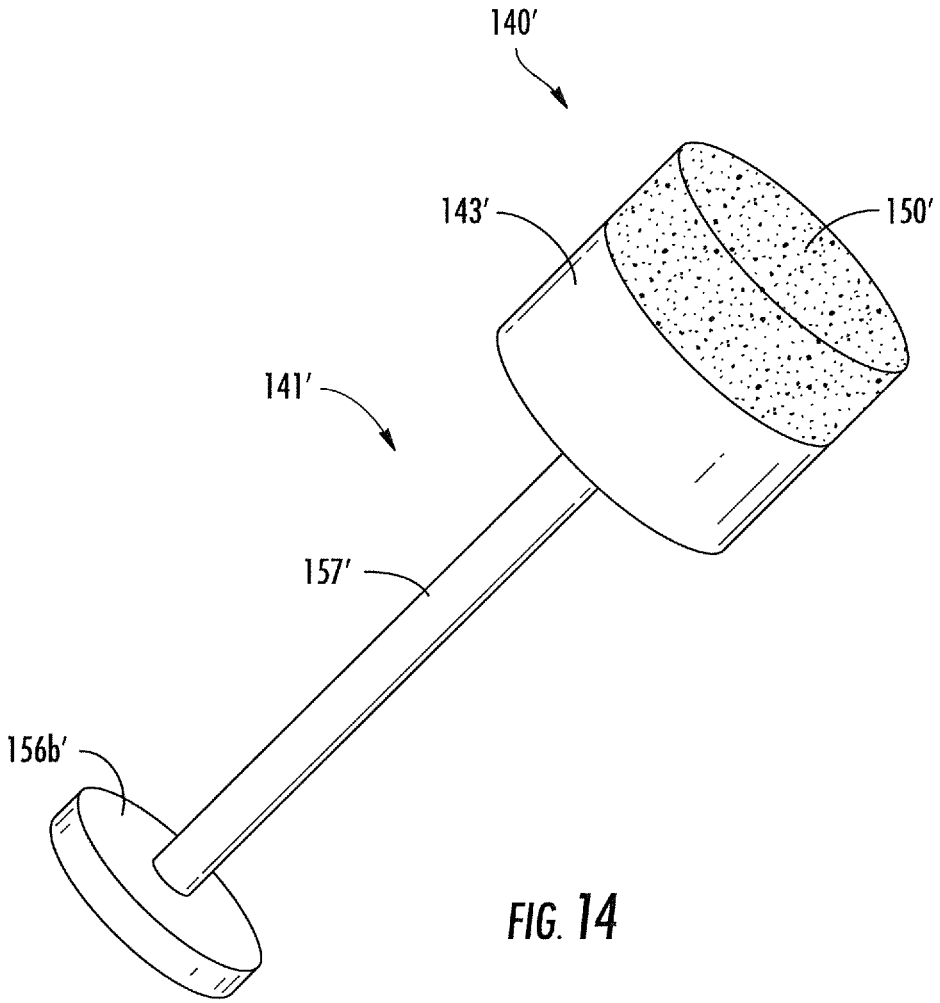
FIG. 14 is a perspective view of the plug device of FIG. 13.

For example, referring now to FIGS. 13 and 14, the cylindrical body 141' has a single enlarged end segment 156*b'* adjacent the distal end 136*b'* of the corresponding pool fence opening 132'. The magnet 143' is coupled to the opposing end of the elongate segment 157'. In other words, the magnet 143' is coupled to one end of the elongate member 157', and the other end of the elongate member has a single enlarged end segment 156*b*f. The enlarged end segment 156*b'* may have a smaller or same size diameter as the magnet 143'.

Figure 15:
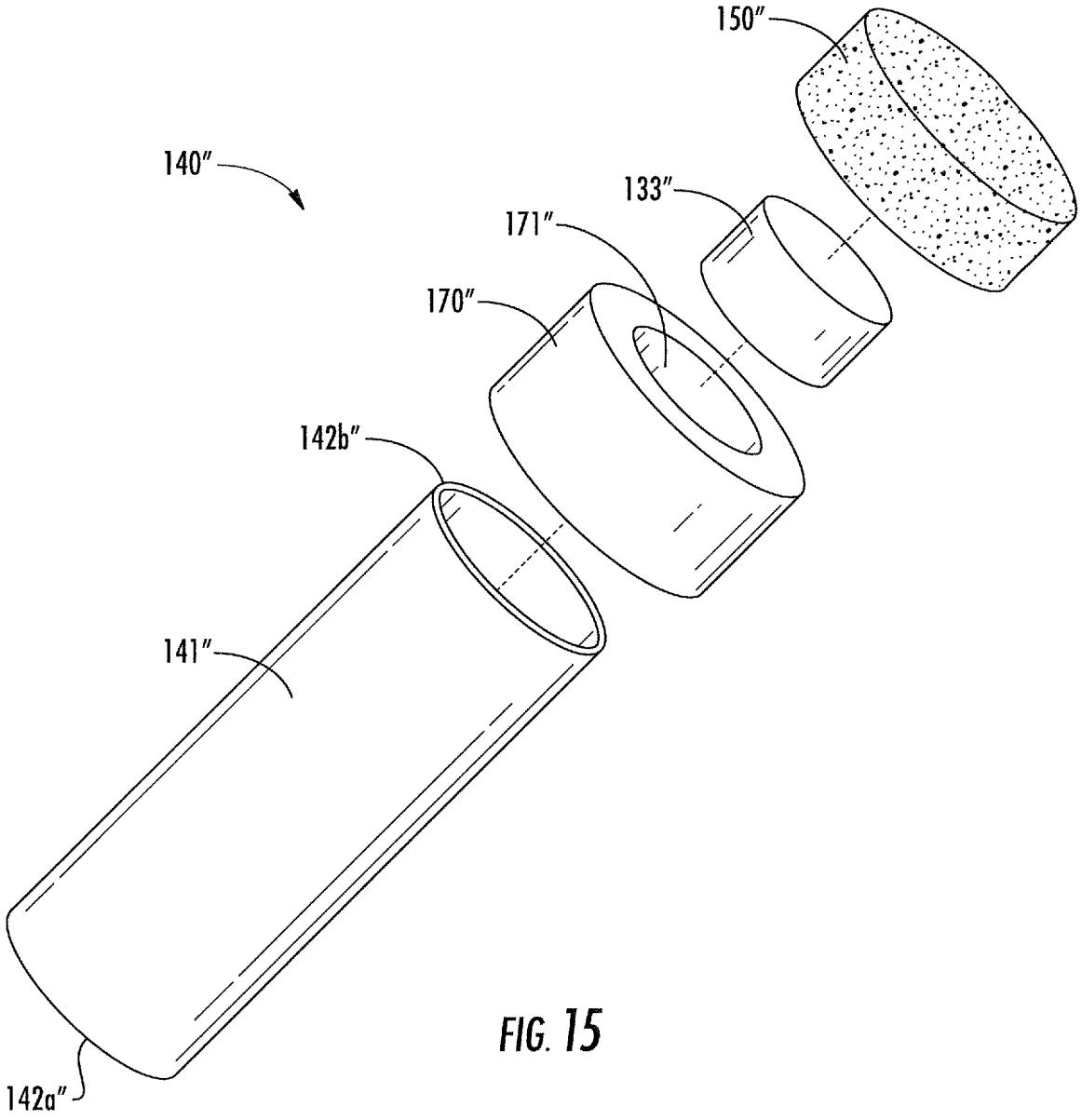
FIG. 15 is an exploded view of a plug device according to an embodiment.

Referring now to FIG. 15, in another embodiment, the plug device 140" may include a magnet holder 170" that has cylindrical shape and a recess 171" or opening therein. The magnet 143" is illustratively carried within the recess 171". In some embodiments, the magnet 143" may be fully embedded within magnet holder 170" and thus the magnet holder would not have any opening therein.

The plug device 40 may advantageously be less of a hazard and more aesthetically pleasing as compared to prior art plug devices, which include a flanged upper end that is elevated or raised with respect to the pool deck 33 and sits on the pool deck even when inserted within the fence post opening. Indeed, as will be appreciated by those skilled in the art, a flanged upper end of the prior art plug devices can be painted to match the pool deck, but since the flanged upper end is raised, it is subject to being tripped over and flaking of the paint.

Additionally, it should be understood by those skilled in the art that the magnet 43 may be sized, for example, based upon its magnetic field magnitude, for desired operation. For example, a smaller, but more powerful magnet may be used with some embodiments, or a larger more powerful magnet may be used with embodiments where the mass of the plug device is larger relative to other embodiments.

A method aspect is directed to a method of making a plug device 40 for a swimming pool fence system 30 that includes spaced apart vertical fence posts 31 to be inserted into corresponding fence post openings 32 in a pool deck 33, and a fencing material 34 coupled between adjacent ones of the spaced apart vertical fence posts. The method includes coupling at least one magnet 43 to a second end 42*b* of a cylindrical body 41 having a first end 42*a* opposing the second end, and wherein the first end is to be adjacent a distal end of a respective fence post opening 32 in the pool deck 33 upon insertion therein. The method also includes coupling a cylindrical pool deck cap 50 to the at least one magnet 43. The cylindrical pool deck cap 50 is to be adjacent a proximal end 36*a* of the respective fence post opening 32 in the pool deck 33 upon insertion therein.

Another method aspect is directed to a method of plugging a fence post opening 32 in a pool deck 33. The method includes inserting a plug device 40 into the fence post opening 32 wherein the plug device includes a cylindrical body xx having opposing first and second ends 42*a*, 42*b* the first end to be inserted into the fence post opening in the pool deck 33, at least one magnet 43 carried by the second end of the cylindrical body, and a cylindrical pool deck cap 50 carried by the at least one magnet.

Figure 16:
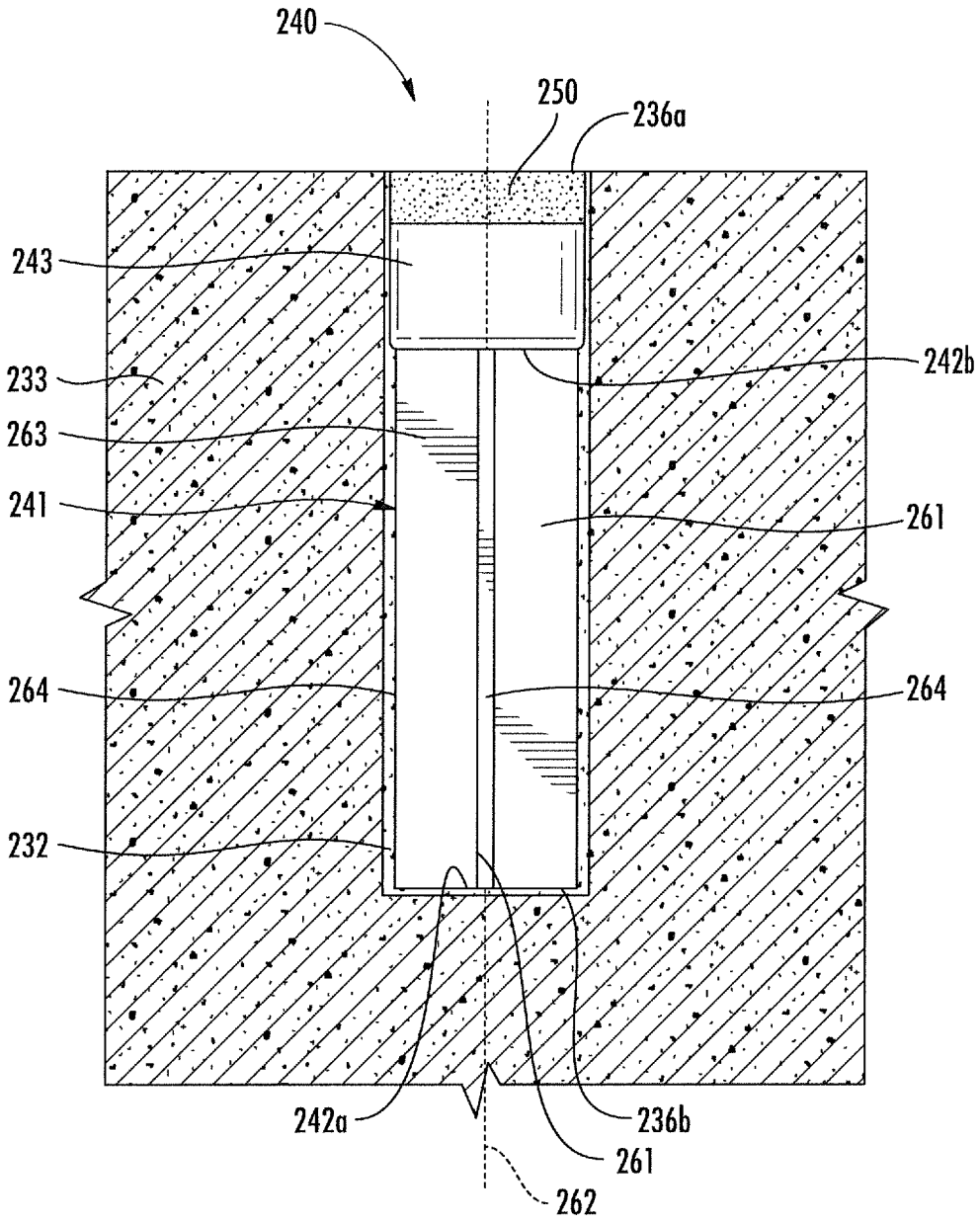
FIG. 16 is a cross sectional view of a pool deck including a plug device according to another embodiment.
Figure 17:
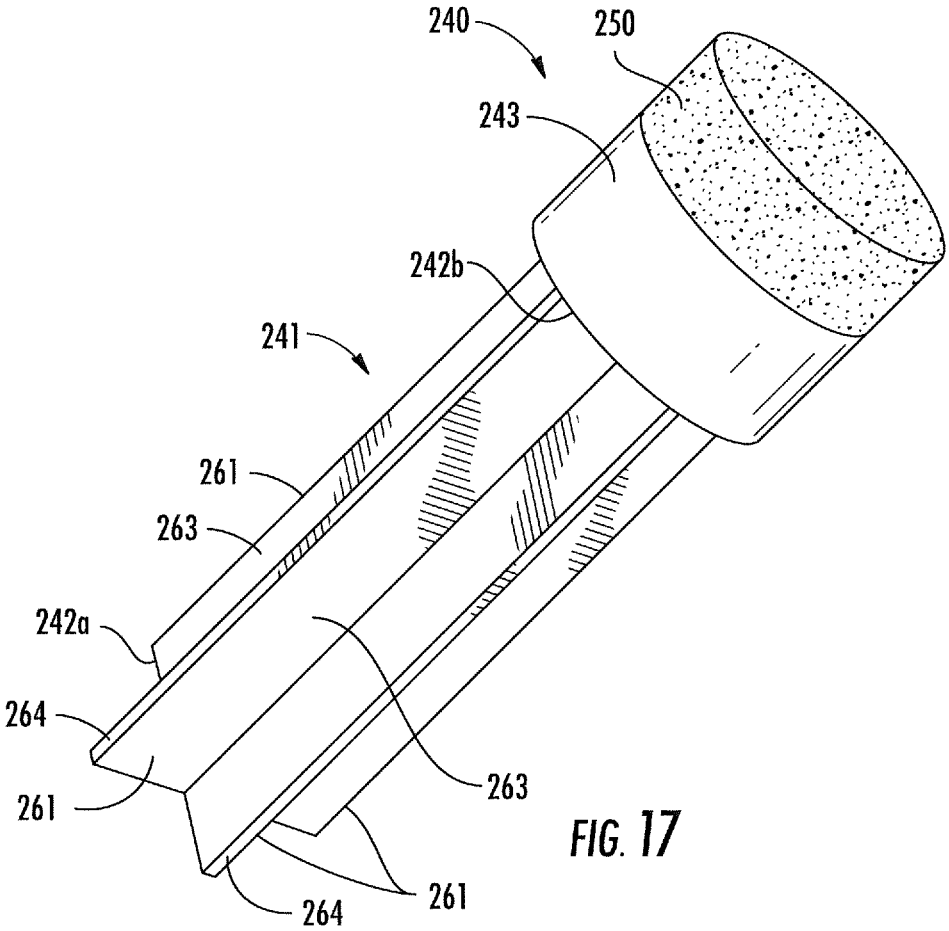
FIG. 17 is a perspective view of the plug device of FIG. 16.

Referring now to FIGS. 16 and 17, in another embodiment a plug device 240 illustratively includes a plug body 241 having opposing first and second ends 242*a*, 242*b*. The first end 242*a* is to be adjacent a distal end 236*b* of a respective fence post opening 232 in the pool deck 233 upon insertion therein. The plug body 241 includes longitudinally extending fins 261 that extend from a center axis 262. More particularly, each of the longitudinal fins 261 extends outwardly from the center axis 262 defining major surfaces 263 and opposing minor surfaces 264.

Figure 18:
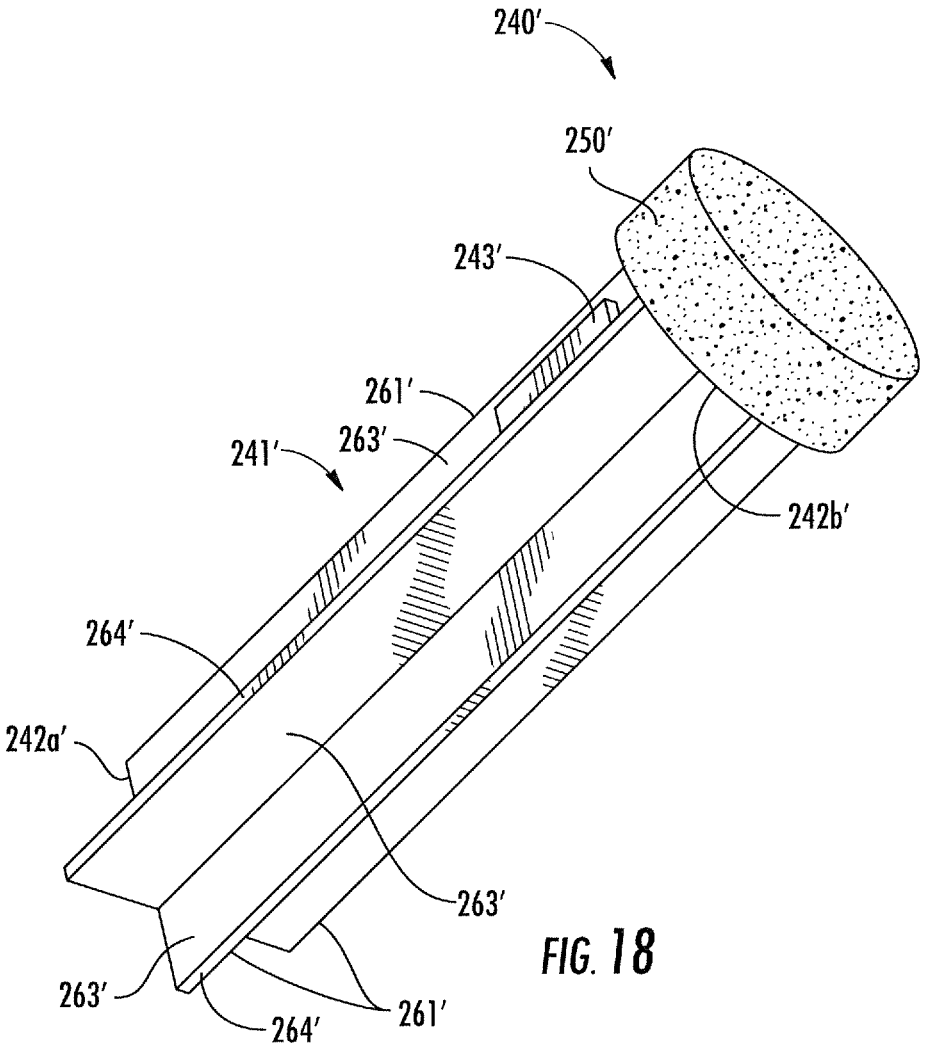
FIG. 18 is a perspective view of a plug device according to another embodiment.

A magnet 243 is carried by the longitudinally extending fins 261 adjacent the second end 242*b*. Referring briefly to FIG. 18, in another embodiment, the magnet 243' may be carried by a major surface 263' of a single fin 261'. While a single magnet is illustrated, it will be appreciated that there may be more than one magnet carried by a single longitudinally extending fin and/or by more than one longitudinally extending fin. A cylindrical pool deck cap 250 is adjacent the second end 242*b* of the plug body 241. The cylindrical pool deck cap 250 is to be adjacent a proximal end 236*a* of the respective fence post opening 232 in the pool deck 233 upon insertion therein.

Figure 19:
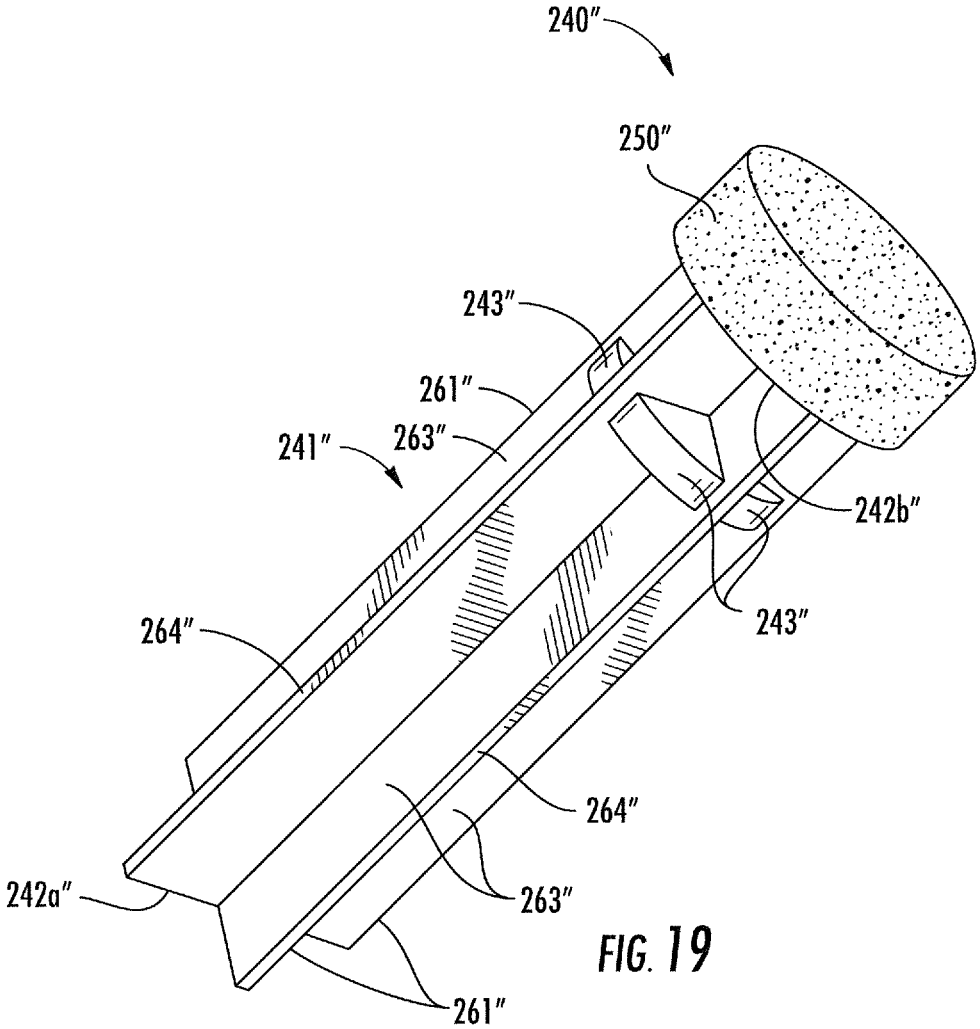
FIG. 19 is a perspective view of a plug device according to another embodiment.

Referring now to FIG. 19, in another embodiment, each of the longitudinally extending fins 261" has an opening therein and the magnet 243" is carried within the openings. In some embodiments, less than all of the longitudinally extending fins 261" (e.g., one) may have an opening carrying the magnet 243" or magnets.

A plug device for a swimming pool fence system comprises a plurality of spaced apart vertical fence posts to be inserted into corresponding fence post openings in a pool deck, and a fencing material coupled between adjacent ones of the plurality of spaced apart vertical fence posts. The plug device comprises a plug body having opposing first and second ends. The first end is to be adjacent a distal end of a respective fence post opening in the pool deck upon insertion therein. The plug body comprises a plurality of longitudinally extending fins. The plug device comprises at least one magnet carried by at least one of the the plurality of longitudinally extending fins adjacent the second end. The plug device comprises a cylindrical pool deck cap adjacent the second end of the plug body. The cylindrical pool deck cap is to be adjacent a proximal end of the respective fence post opening in the pool deck upon insertion therein.

Each of the plurality of longitudinal fins extends outwardly from an axis defining major surfaces and opposing minor surfaces.

The at least one magnet is carried by one of the minor surfaces of each of the plurality of fins adjacent the second end.

The at least one of the plurality of fins has an opening therein, and wherein the at least one magnet is carried within the opening.

The plurality of fins each has an opening therein, and wherein the at least one magnet is carried within each of the openings.

The at least one magnet comprises a plurality of magnets.

It should be understood that elements from any of the embodiments described herein may be used with any one or more elements from other embodiments. For example, a cylindrical magnet may be carried in a recess in the pool deck cap and may be used with a plug body having longitudinally extending fins, or a cylindrical magnet may be carried by a top surface (upper minor surface) of the fins.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A plug device for a swimming pool fence system comprising a plurality of spaced apart vertical fence posts to be inserted into corresponding fence post openings in a pool deck, and a fencing material coupled between adjacent ones of the plurality of spaced apart vertical fence posts, the plug device comprising:

a cylindrical body having opposing first and second ends, the first end to be adjacent a distal end of a respective fence post opening in the pool deck upon insertion therein;

at least one magnet carried by the second end of the cylindrical body; and a cylindrical pool deck cap carried by said at least one magnet, the cylindrical pool deck cap to be adjacent a proximal end of the respective fence post opening in the pool deck upon insertion therein.

2. The plug device of claim 1 wherein said at least one magnet has a cylindrical shape.

3. The plug device of claim 1 wherein said at least one magnet and said cylindrical pool deck cap each has a diameter within +/−25% of each other.

4. The plug device of claim 1 wherein said cylindrical pool deck cap comprises a cylindrical frame carried by said at least one magnet and having an opening therein, and a pool deck insert body carried within the opening.

5. The plug device of claim 1 wherein said cylindrical body, said at least one magnet, and said cylindrical pool deck cap have a combined length within a range of 4-inches+/−1-inch.

6. The plug device of claim 1 wherein said cylindrical body has at least one enlarged cylindrical end segment and an elongate segment coupled thereto having a reduced width relative to the enlarged cylindrical end segment.

7. The plug device of claim 6 wherein said at least one enlarged cylindrical end segment comprises first and second enlarged cylindrical end segments coupled to opposing ends of said elongate segment.

8. The plug device of claim 1 wherein said cylindrical body and said cylindrical pool deck cap each has a diameter in a range of 1-inch+/−0.5 inches.

9. The plug device of claim 1 wherein said cylindrical body comprises a solid cylindrical body.

10. The plug device of claim 1 wherein said cylindrical pool deck cap comprises a solid cylindrical pool deck cap.

11. The plug device of claim 1 wherein said cylindrical pool deck cap has a groove therein along a circumference thereof; and wherein said plug device further comprises a seal carried within the groove.

12. The plug device of claim 1 wherein said cylindrical pool deck cap has a planar end surface aligned in plane with the pool deck.

13. A plug device for a swimming pool fence system comprising a plurality of spaced apart vertical fence posts to be inserted into corresponding fence post openings in a pool deck, and a fencing material coupled between adjacent ones of the plurality of spaced apart vertical fence posts, the plug device comprising:

a cylindrical body;

at least one cylindrically shaped magnet carried by an end of the cylindrical body; and a cylindrical pool deck cap carried by said at least one cylindrically shaped magnet and having a diameter within +/−25% of a diameter of said at least one cylindrically shaped magnet.

14. The plug device of claim 13 wherein said cylindrical pool deck cap comprises a cylindrical frame carried by said at least one cylindrically shaped magnet and having an opening therein, and a pool deck insert body carried within the opening.

15. The plug device of claim 13 wherein said cylindrical body, said at least one cylindrically shaped magnet, and said cylindrical pool deck cap have a combined length within a range of 4-inches+/−1-inch.

16. The plug device of claim 13 wherein said cylindrical body and said cylindrical pool deck cap each has a diameter in a range of 1-inch+/−0.5 inches.

17. The plug device of claim 13 wherein said cylindrical body comprises a solid cylindrical body.

18. A method of making a plug device for a swimming pool fence system comprising a plurality of spaced apart vertical fence posts to be inserted into corresponding fence post openings in a pool deck, and a fencing material coupled between adjacent ones of the plurality of spaced apart vertical fence posts, the method comprising:

coupling at least one magnet to a second end of a cylindrical body having a first end opposing the second end, the first end to be inserted into a fence post opening in the pool deck, the first end to be adjacent a distal end of a respective fence post opening in the pool deck upon insertion therein; and coupling a cylindrical pool deck cap to the at least one magnet, the cylindrical pool deck cap to be adjacent a proximal end of the respective fence post opening in the pool deck upon insertion therein.

19. The method of claim 18 wherein the at least one magnet has a cylindrical shape.

20. The method of claim 18 wherein the at least one magnet and the cylindrical pool deck cap each has a diameter within +/−25% of each other.

* * * * *